US010583655B2

(12) United States Patent
Tanaka

(10) Patent No.: US 10,583,655 B2
(45) **Date of Patent: *Mar. 10, 2020**

(54) LIQUID EJECTION DEVICE

(71) Applicant: BROTHER KOGYO KABUSHIKI KAISHA, Nagoya-shi, Aichi-ken (JP)

(72) Inventor: Taiki Tanaka, Yokkaichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/113,429

(22) Filed: Aug. 27, 2018

(65) Prior Publication Data

US 2019/0092015 A1 Mar. 28, 2019

Related U.S. Application Data

(63) Continuation of application No. 15/409,762, filed on Jan. 19, 2017, now Pat. No. 10,081,180.

(30) Foreign Application Priority Data

Jan. 25, 2016 (JP) ..... 2016-011384

(51) Int. Cl.
*B41J 2/14* (2006.01)

(52) U.S. Cl.
CPC ..... *B41J 2/14233* (2013.01); *B41J 2/14201* (2013.01); *B41J 2002/14419* (2013.01); *B41J 2002/14491* (2013.01)

(58) Field of Classification Search
CPC ..... B41J 2/14233; B41J 2/14201; B41J 2002/14419; B41J 2002/14491
See application file for complete search history.

(56) References Cited

U.S. PATENT DOCUMENTS 10,081,180 B2 * 9/2018 Tanaka ..... B41J 2/14233
2003/0020787 A1 1/2003 Nakamura et al.
2014/0232787 A1 8/2014 Owaki

FOREIGN PATENT DOCUMENTS

JP 2008-273218 A 11/2008
JP 2010-082902 A 4/2010
(Continued)

OTHER PUBLICATIONS

United States Notice of Allowance dated May 22, 2018 received in related U.S. Appl. No. 15/409,762.
(Continued)

*Primary Examiner* — Sharon A. Polk
(74) *Attorney, Agent, or Firm* — Scully, Scott, Murphy & Presser, P.C.

(57) ABSTRACT

A liquid ejection device is disclosed. One device includes a plurality of contacts aligned along a first direction. The plurality of contacts are positioned between two piezoelectric-element rows of four piezoelectric-element rows in a second direction orthogonal to the first direction. Each of the two piezoelectric-element rows is closer to a center line of a first substrate with respect to the second direction than each of another two piezoelectric-element rows of the four piezoelectric-element rows in the second direction. Each of a plurality of piezoelectric elements of a four piezoelectric-element rows is individually connected with a corresponding one of the plurality of contacts, respectively. One of the plurality of piezoelectric elements of the another two piezoelectric-element rows connect with a corresponding one of the plurality of contacts.

10 Claims, 12 Drawing Sheets

(56) References Cited

FOREIGN PATENT DOCUMENTS

| | | | |
|---|---|---|---|
| JP | 2011-140241 | A | 7/2011 |
| JP | 2014-156065 | A | 8/2014 |
| WO | 01/0062499 | A1 | 8/2001 |

OTHER PUBLICATIONS

United States Official Action dated Nov. 17, 2017 received in related U.S. Appl. No. 15/409,762.

Notice of Reasons for Refusal dated Dec. 10, 2019 received in Japanese Patent Application No. JP 2016-011384 together with an English language translation.

* cited by examiner

LIQUID EJECTION DEVICE

CROSS-REFERENCE TO RELATED APPLICATION

This application is a continuation application of U.S. Ser. No. 15/409,762 filed on Jan. 19, 2017 and claims priority from Japanese Patent Application No. 2016-011384 filed on Jan. 25, 2016, the content of which is incorporated herein by reference in its entirety.

FIELD OF DISCLOSURE

Aspects disclosed herein relate to a liquid ejection device.

BACKGROUND

An inkjet head that ejects ink from nozzles has been known as a liquid ejection device. For example, the known inkjet head includes a pressure chamber substrate having pressure chambers communicating with nozzles. The pressure chamber substrate includes piezoelectric elements provided corresponding to the pressure chambers.

The pressure chambers are aligned in four rows in the pressure chamber substrate. The piezoelectric elements are also aligned in four rows in accordance with the arrangement pattern of the pressure chambers. Leads extend from the respective piezoelectric elements in a direction orthogonal to a direction in which the piezoelectric elements are aligned, i.e., the leads extend outwardly with respect to a direction in which the four piezoelectric-element rows are positioned side by side (hereinafter, referred to as the "side-by-side direction"). The leads are connected to respective contacts (e.g., segment terminals) positioned at end portions of the pressure chamber substrate in the side-by-side direction. The contacts are aligned in a row on each of the end portions of the pressure chamber substrate. The leads extending from the piezoelectric-element rows extend outwardly toward the respective corresponding contacts disposed on either of the end portions in the side-by-side direction. In the pressure chamber substrate, a wiring member (e.g., a tape carrier package ("TCP")) is joined to each of the end portions on which the contacts are located. In each of the end portions, the wiring member and the contacts are electrically connected to each other.

SUMMARY

In the known method of manufacturing inkjet heads, piezoelectric elements may be formed on a silicon substrate by forming various layers including an electrode layer and a piezoelectric layer on the silicon substrate. In this manufacturing method, a plurality of piezoelectric elements may be formed on a single silicon wafer, and then, the wafer may be cut into a plurality of pieces of substrates each having a predetermined size. Each separate substrates may be used as a pressure chamber substrate for a single inkjet head. That is, a plurality of pressure chamber substrates for a plurality of inkjet heads may be cut from a single silicon wafer.

Nevertheless, if the silicon wafer is cut into large pieces of pressure chamber substrates, only small number of pressure chamber substrates may be obtained. Thus, this may result in increased cost of the individual pressure chamber substrates. Therefore, in light of cost reduction, it may be preferable that individual pressure chamber substrates have a relatively small size to increase the number of pressure chamber substrates that can be obtained from a single wafer.

Nevertheless, in the known inkjet head, the contacts may be located on the opposite end portions of the pressure chamber substrate in the side-by-side direction. That is, the pressure chamber substrate may have two locations, at each of which a wiring member is joined to the contacts, and this configuration may cause increase in size of the pressure chamber substrate correspondingly.

Accordingly, some embodiments of the disclosure provide for a liquid ejection device including piezoelectric elements aligned in four rows, wherein contacts corresponding to the piezoelectric elements are gathered at a single location to reduce a size of a substrate on which the piezoelectric elements are positioned.

According to one aspect of the disclosure, a liquid ejection device includes a first substrate having four pressure-chamber rows. Each of the four pressure-chamber rows has a plurality of pressure chambers. Each of the four pressure-chamber rows extends along a first direction. Each of the four pressure-chamber rows is offset from one another in a second direction orthogonal to the first direction. The liquid ejection device includes four piezoelectric-element rows positioned corresponding to the four pressure-chamber rows, respectively. Each of the four piezoelectric-element rows has a plurality of piezoelectric elements. Each of the four piezoelectric-element rows extends along the first direction. Each of the four piezoelectric-element rows is offset from one another in the second direction. The liquid ejection device includes a plurality of contacts aligned along the first direction. The plurality of contacts are positioned between two piezoelectric-element rows of the four piezoelectric-element rows in the second direction. Each of the two piezoelectric-element rows is closer to a center line of the first substrate with respect to the second direction than each of another two piezoelectric-element rows of the four piezoelectric-element rows in the second direction. Each of the plurality of piezoelectric elements of the four piezoelectric-element rows is individually connected with a corresponding one of the plurality of contacts, respectively. One of the plurality of piezoelectric elements of the another two piezoelectric-element rows connect with a corresponding one of the plurality of contacts.

According to further aspect of the disclosure, a liquid ejection device includes a first substrate having four pressure-chamber rows. Each of the four pressure-chamber rows has a plurality of pressure chambers. Each of the four pressure-chamber rows extends along a first direction. Each of the four pressure-chamber rows is offset from one another in a second direction orthogonal to the first direction. The liquid ejection device includes four piezoelectric-element rows positioned corresponding to the four pressure-chamber rows, respectively. Each of the four piezoelectric-element rows has a plurality of piezoelectric elements. Each of the four piezoelectric-element rows extends along the first direction. Each of the four piezoelectric-element rows is offset from one another in the second direction. The liquid ejection device includes a plurality of contacts aligned along the first direction. The plurality of contacts are positioned between two piezoelectric-element rows of the four piezoelectric-element rows in the second direction. The two piezoelectric-element rows are positioned between another two piezoelectric-element rows of the four piezoelectric-element rows in the second direction. Each of the plurality of piezoelectric elements of the four piezoelectric-element rows is individually connected with a corresponding one of the plurality of contacts, respectively. One of the plurality of piezoelectric elements of the another two piezoelectric-element rows connect with a corresponding one of the plurality of contacts.

According to further aspect of the disclosure, a liquid ejection device includes a first substrate having four pressure-chamber rows. Each of the pressure-chamber rows has a plurality of pressure chambers. Each of the four pressure-chamber rows extends along a first direction. Each of the four pressure-chamber rows is offset from one another in a second direction orthogonal to the first direction. The liquid ejection device includes four piezoelectric element rows positioned corresponding to the four pressure chamber rows, respectively. Each of the four piezoelectric-element rows has a plurality of piezoelectric elements. Each of the four piezoelectric-element rows extends along the first direction. Each of the four piezoelectric-element rows is offset from one another in the second direction. The liquid ejection device includes a second substrate. The second substrate includes a first common liquid chamber positioned opposite to the piezoelectric elements relative to the first substrate, the first common liquid chamber corresponding to two pressure-chamber rows. Each of the two pressure-chamber rows is closer to a center line of the first substrate in the second direction than each of another two pressure-chamber rows in the second direction. The second substrate includes a second common liquid chamber positioned on one side relative to the first common liquid chamber in the second direction. The second common liquid chamber corresponding to one of the another two pressure-chamber rows. The second substrate includes a third common liquid chamber positioned on the other side relative to the first common liquid chamber in the second direction. The third common liquid chamber corresponding to the other of the another two pressure-chamber rows. The liquid ejection device includes a plurality of contacts positioned between the two pressure-chamber rows in the second direction. The liquid ejection device includes a wiring member electrically joined to the plurality of contacts. The plurality of contacts overlap the first common liquid chamber when viewed in a direction in which the first substrate and the second substrate are laminated on one another. A support is disposed in the first common liquid chamber of the second substrate.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
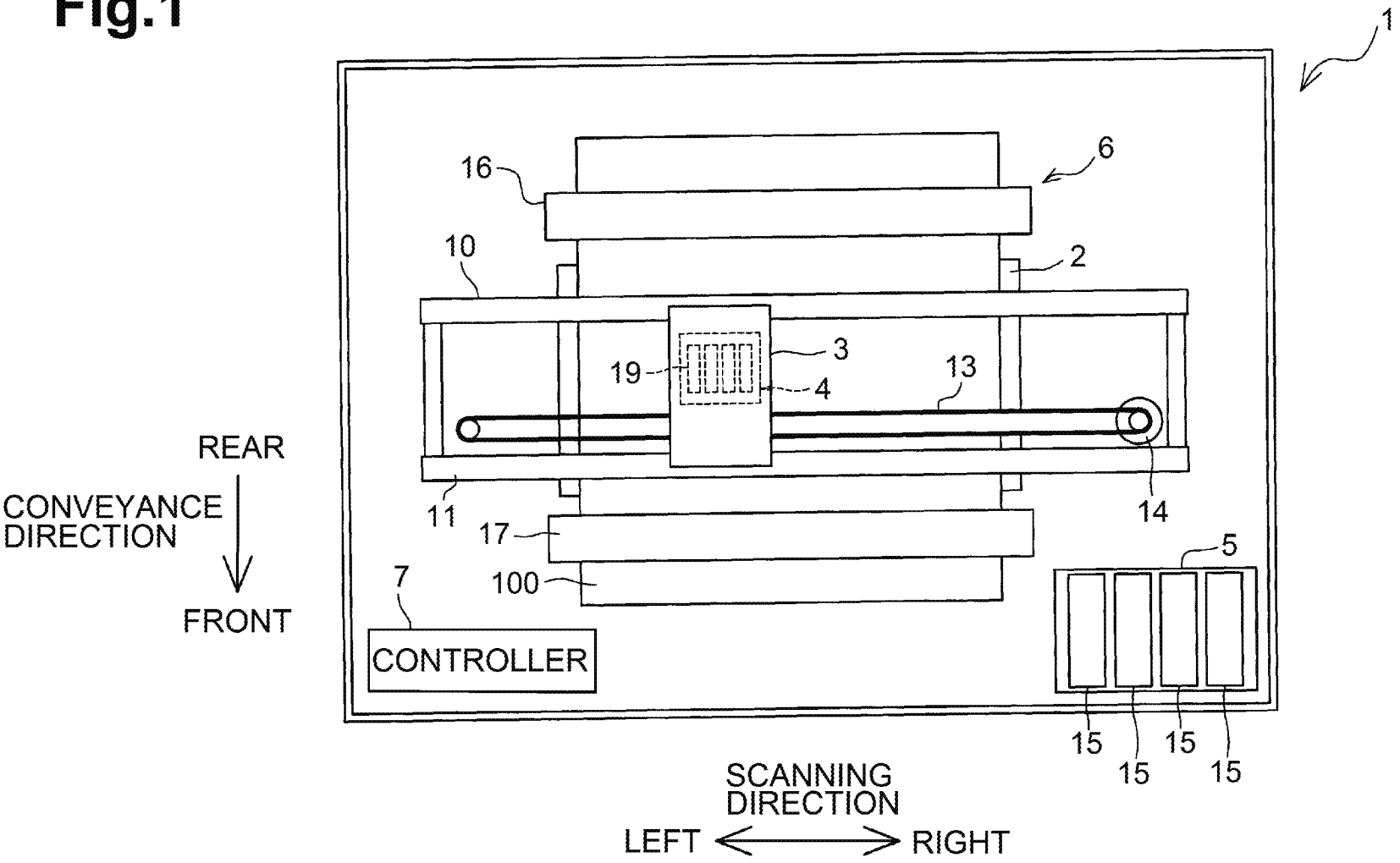
FIG. 1 is a schematic plan view of a printer in an illustrative embodiment according to one or more aspects of the disclosure.

An illustrative embodiment will be described with reference to the accompanying drawings. FIG. 1 is a schematic plan view of an inkjet printer 1 according to the illustrative embodiment. The front, rear, right, and left defined in FIG. 1 are applied to the front, rear, right, and left of the inkjet printer 1. The top and bottom of the inkjet printer 1 may be defined with reference to an orientation of the inkjet printer 1 that may be disposed in which it may be intended to be used. For example, in FIG. 1, the near side of the drawing sheet of FIG. 1 may be the top of the inkjet printer 1 and the far side of the drawing sheet of FIG. 1 may be the bottom of the inkjet printer 1. Hereinafter, an explanation will be made with reference to the defined directions appropriately.

(General Configuration of Printer)

As illustrated in FIG. 1, the inkjet printer 1 includes a platen 2, a carriage 3, an inkjet head 4, a cartridge holder 5, a conveyor 6, and a controller 7.

The platen 2 is configured to support a recording sheet 100 (e.g., a recording medium) on an upper surface thereof. The carriage 3 is configured to reciprocate in a right-left direction along guide rails 10 and 11 in an area facing the platen 2. Hereinafter, the direction in which the carriage 3 reciprocates (e.g., the right-left direction) may also be referred to as a "scanning direction". An endless belt 13 is connected to the carriage 3. The endless belt 13 rotates by driving of a carriage drive motor 14. By rotation of the endless belt 13, the carriage 3 moves in the scanning direction.

The inkjet head 4 is mounted on the carriage 3. The inkjet head 4 is configured to move along the scanning direction together with the carriage 3. The inkjet head 4 includes a plurality of, for example, four head units 19 that are placed side by side in the scanning direction. Each of the head units 19 has nozzles 36 (refer to FIGS. 2 to 5) in its lower surface (not shown in FIG. 1). The head units 19 will be described in detail later.

The cartridge holder 5 is configured such that ink cartridges 15 storing respective color inks (e.g., black, yellow, cyan, and magenta) are attachable thereto and detachable therefrom independently. The ink cartridges 15 are connected to the respective corresponding head units 19 via respective tubes (not illustrated). Inks stored in the respective ink cartridges 15 are supplied to the respective corresponding head units 19 via the respective tubes. In accordance with reciprocation of the carriage 3, one or more of the head units 19 eject ink from the nozzles 36 toward a recording sheet 100 supported by the platen 2.

The conveyor 6 includes a plurality of, for example, two conveyor rollers 16 and 17. The conveyor rollers 16 and 17 are disposed opposite to each other across the platen 2 in a front-rear direction. The conveyor rollers 16 and 17 are driven by a conveyor motor (not illustrated) simultaneously to convey a recording sheet 100 frontward. Hereinafter, a direction in which a recording sheet 100 is conveyed (e.g., the front-rear direction) may be also referred to as a "conveyance direction".

The controller 7 includes a central processing unit ("CPU"), a read only memory ("ROM"), a random access memory ("RAM"), and an application specific integrated circuit ("ASIC"). The CPU executes an appropriate program stored in the ROM to cause the ASIC to perform various processes, e.g., a printing process. For example, in the printing process, based on a print instruction inputted from an external device, e.g., a personal computer, the controller 7 controls the inkjet head 4, the carriage drive motor 14, and the conveyor motor for the conveyor 6 to print an image onto a recording sheet 100. More specifically, for example, the controller 7 executes alternately and repeatedly control for ejecting ink and control for conveying a recording sheet 100. In ink ejection control, the controller 7 causes the inkjet head 4 to eject ink therefrom while moving the inkjet head 4 along the scanning direction together with the carriage 3. In sheet conveyance control, the controller 7 causes the conveyor 6 to convey the recording sheet 100 by a predetermined amount by the conveyor rollers 16 and 17.

<Details of Head Units>

Figure 2:
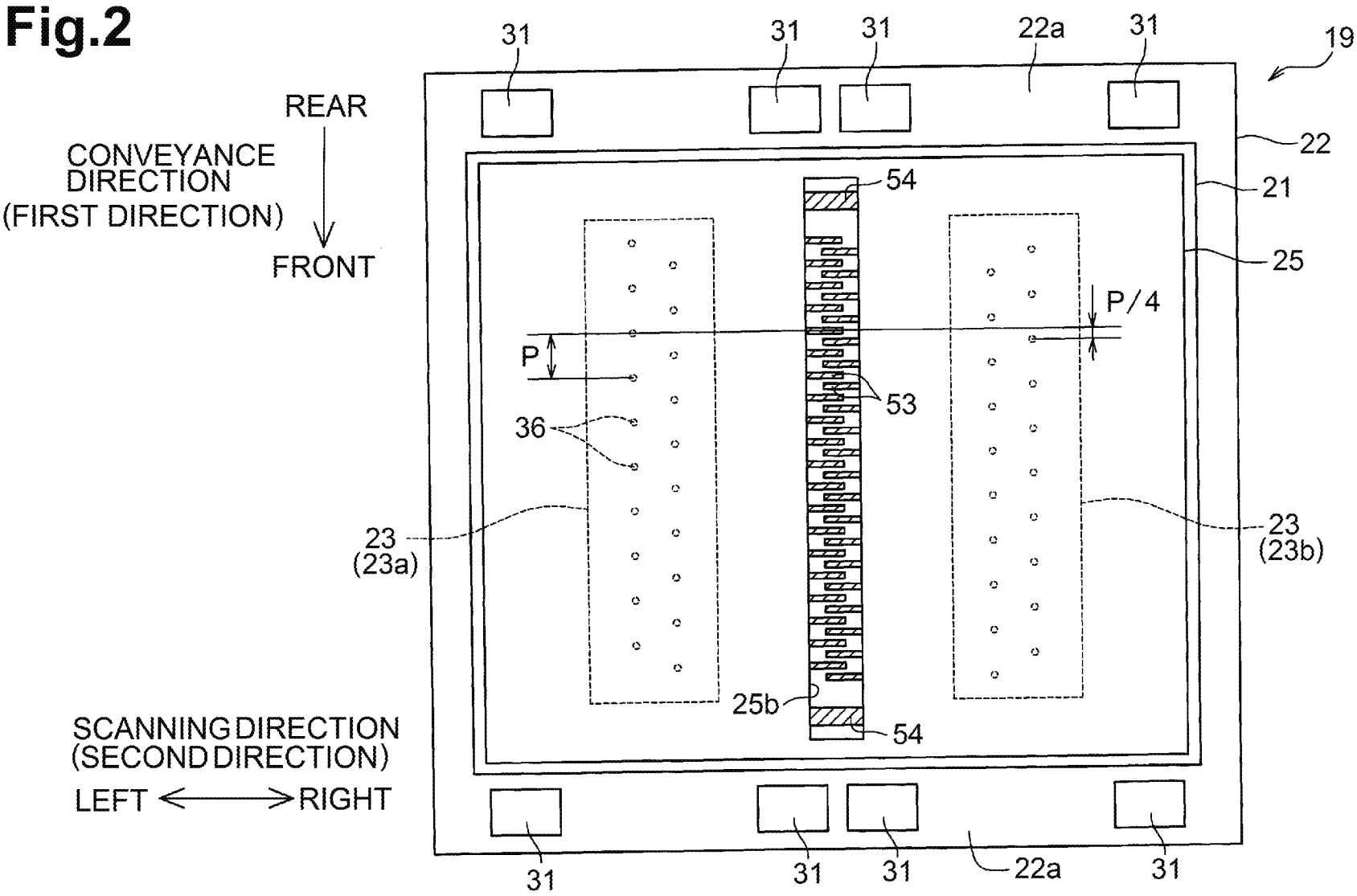
FIG. 2 is a top plan view of one of head units in the illustrative embodiment according to one or more aspects of the disclosure.
Figure 3:
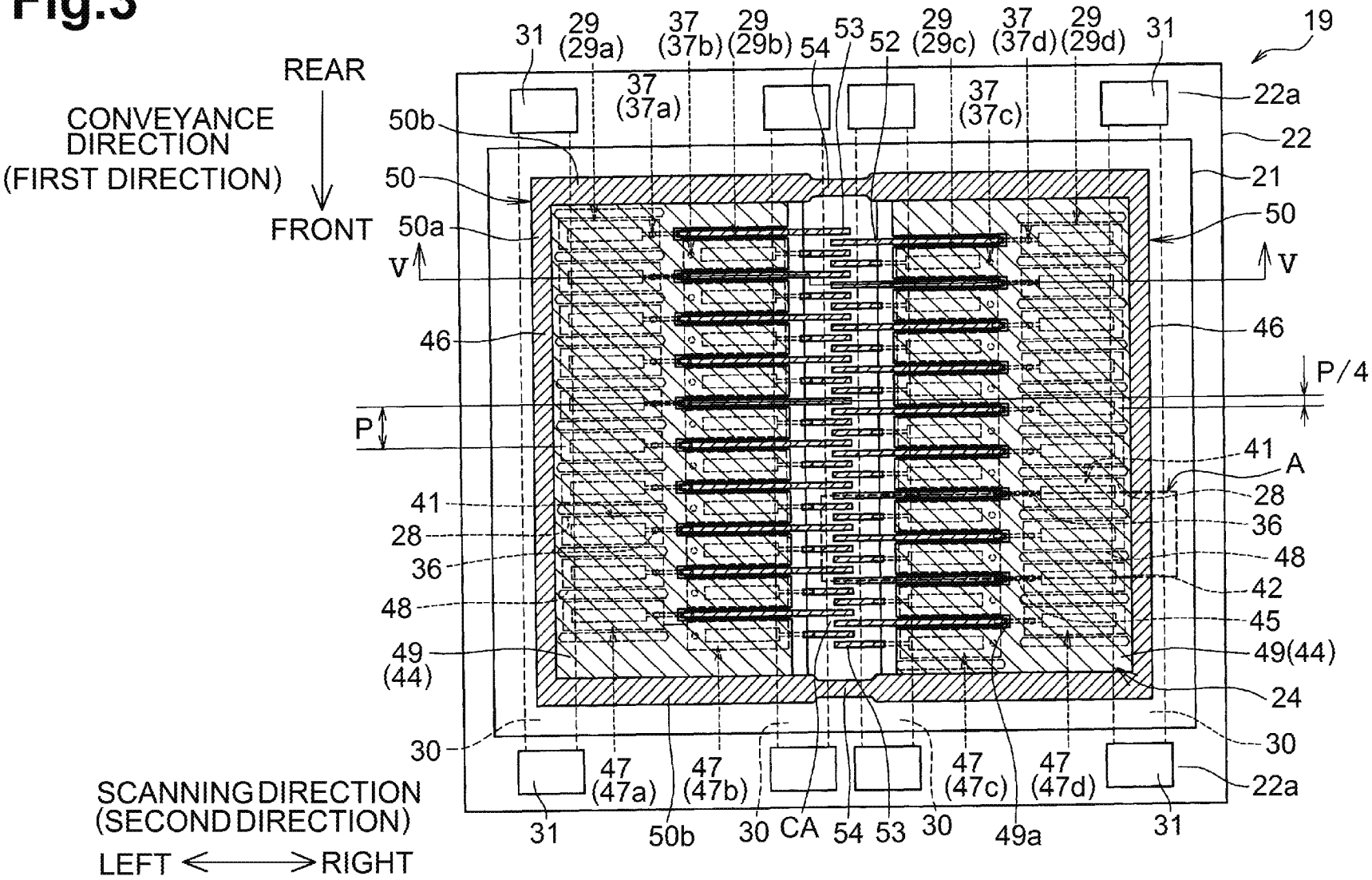
FIG. 3 is a top plan view of the head unit in the illustrative embodiment according to one or more aspects of the disclosure, wherein a cover member is omitted.
Figure 4:
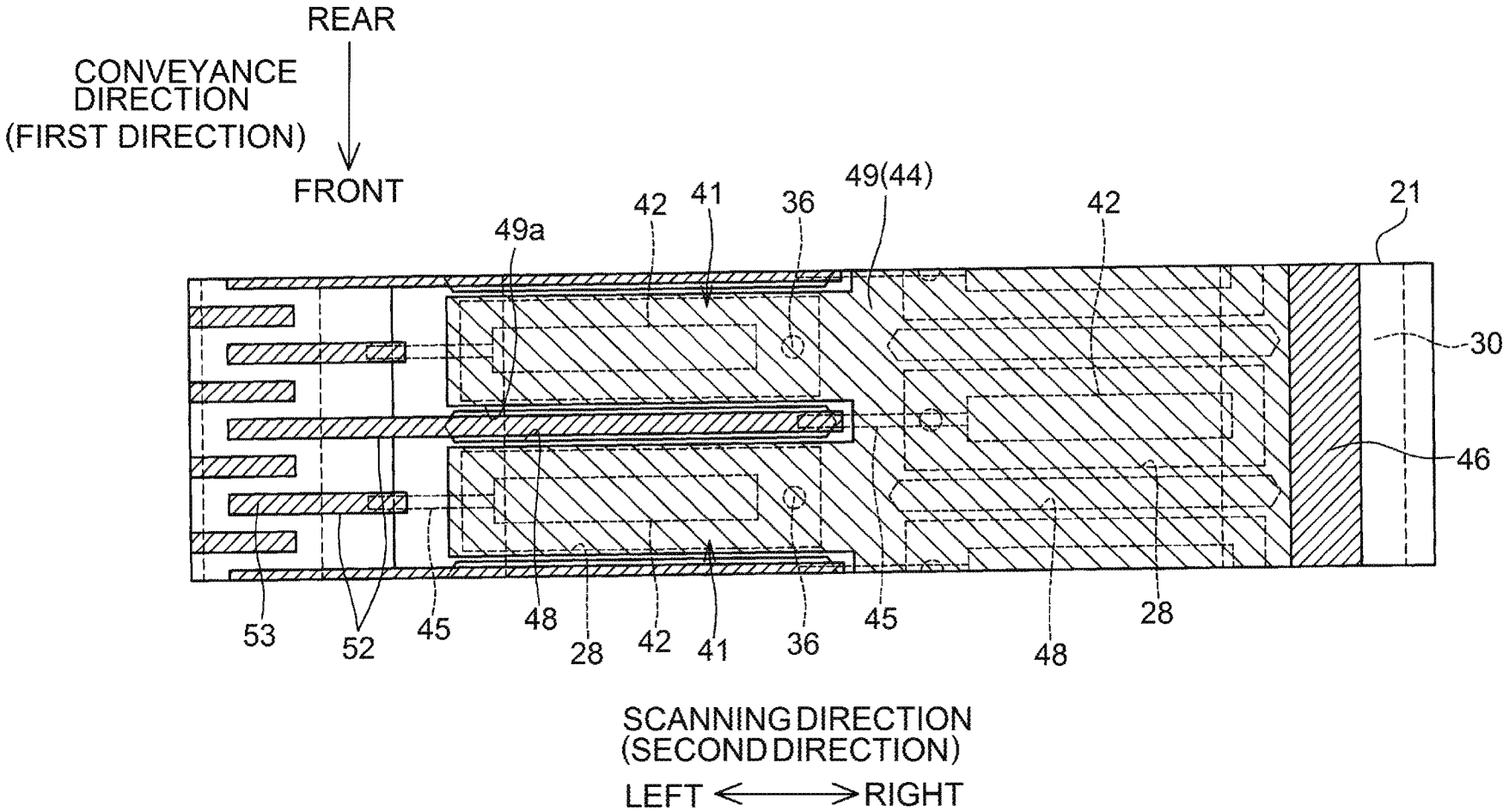
FIG. 4 is an enlarged view of a portion A of FIG. 3 in the illustrative embodiment according to one or more aspects of the disclosure.
Figure 5:
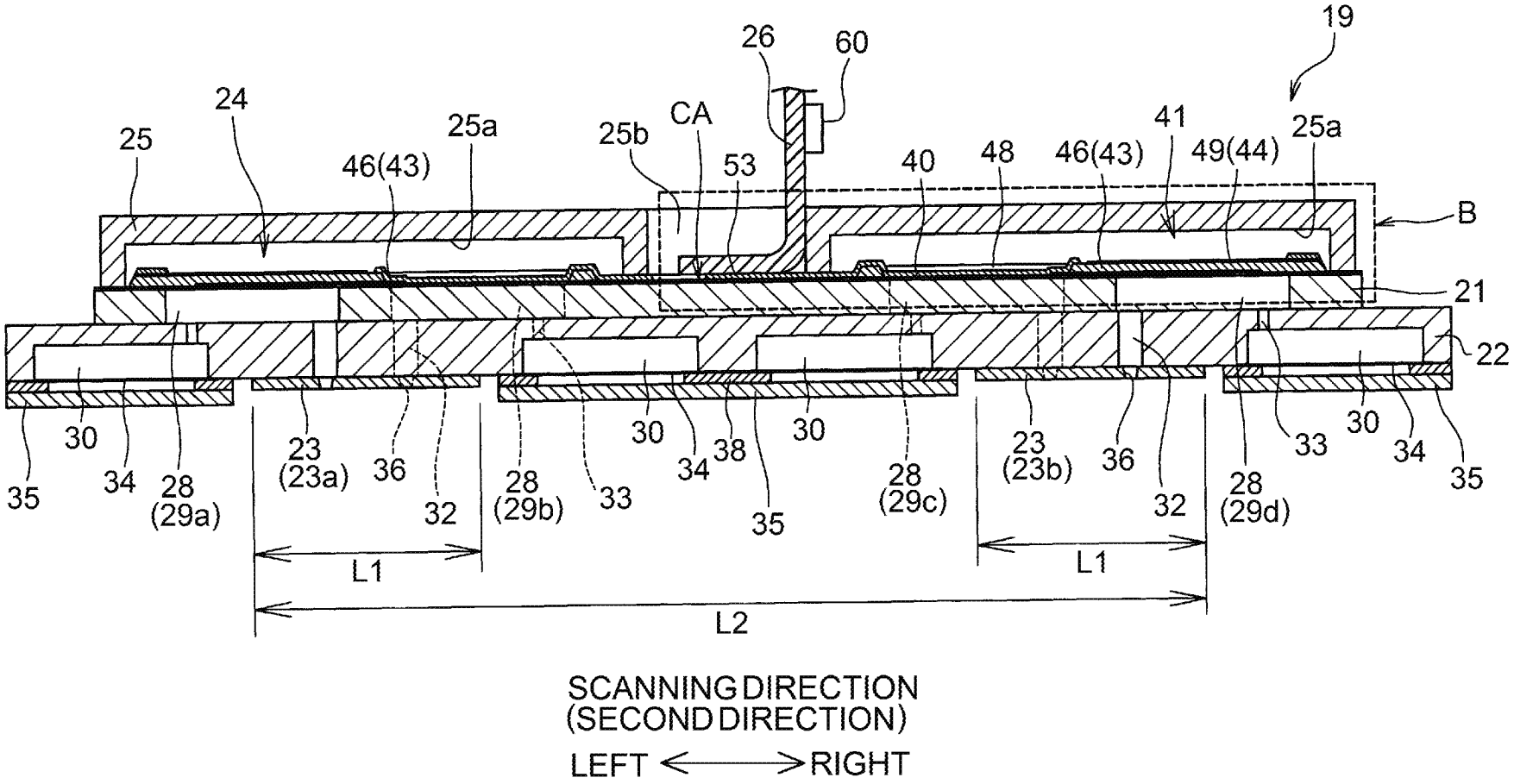
FIG. 5 is a sectional view taken along line V-V of FIG. 3 in the illustrative embodiment according to one or more aspects of the disclosure.
Figure 6:
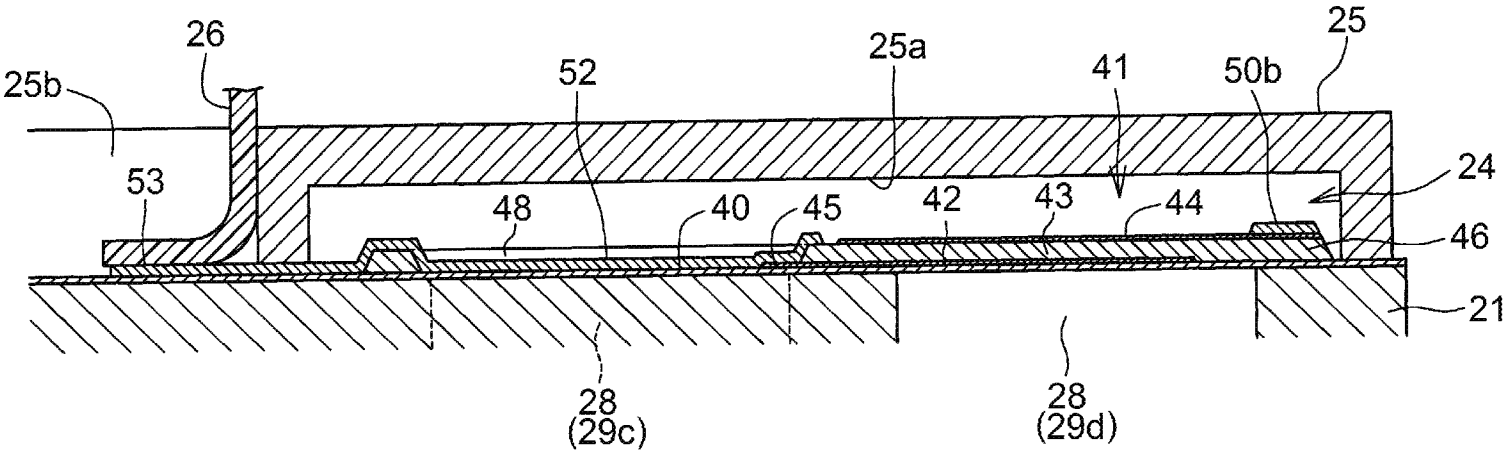
FIG. 6 is an enlarged view of a portion B of FIG. 5 in the illustrative embodiment according to one or more aspects of the disclosure.

Hereinafter, the head units 19 will be described in detail. All the four head units 19 have the same or similar configuration and function in the same or similar manner to each other. Therefore, one of the head units 19 will be described in detail, and an explanation for the others will be omitted. FIG. 2 is a top plan view of one of the head units 19. FIG. 3 is a top plan view of the head unit 19, in which a cover member 25 is omitted. FIG. 4 is an enlarged view of a portion A of FIG. 3. FIG. 5 is a sectional view taken along line V-V of FIG. 3. FIG. 6 is an enlarged view of a portion B of FIG. 5. As illustrated in FIGS. 2 to 5, the head unit 19 includes a first substrate 21, a second substrate 22, a plurality of, for example, two nozzle plates 23 (e.g., 23*a* and 23*b*), a piezoelectric actuator 24, a cover member 25, and a chip-on-film ("COF") 26.

(First Substrate, Second Substrate, and Nozzle Plates)

Hereinafter, the first substrate 21, the second substrate 22, and the nozzle plates 23 will be described. The first substrate 21, the second substrate 22, and the nozzle plates 23 each may be formed of a single-crystalline silicon substrate. These substrates or plates are laminated in a top-bottom direction such that the first substrate 21 is located at the top of the laminated structure, the second substrate 22 is located below the first substrates 21, and the nozzle plates 23 are located below the second substrate 22.

The first substrate 21 has a plurality of pressure chambers 28. Each pressure chamber 28 has a rectangular shape having longer sides extending along the scanning direction in plan view. The pressure chambers 28 constitute a plurality of, for example, four pressure-chamber rows 29 (e.g., 29*a*, 29*b*, 29*c*, and 29*d*) that extend along the conveyance direction and are positioned side by side in the scanning direction. The pressure chambers 28 are aligned along the conveyance direction in each pressure-chamber row 29. Between the pressure-chamber rows 29*a*, 29*b*, 29*c*, and 29*d*, the pressure chambers 28 are located at the respective different positions along the conveyance direction. More specifically, for example, the pressure chambers 28 in each pressure-chamber row 29 are spaced apart from each other with a pitch P in the conveyance direction. Between the four pressure-chamber rows 29, a pressure chamber 28 in one (e.g., the pressure-chamber row 29*a*) of the pressure-chamber rows 29 is spaced with a pitch P/4 from a pressure chamber 28 in another (e.g., the pressure-chamber row 29*d*) of the pressure-chamber rows 29 in the conveyance direction.

The second substrate 22 is positioned below the first substrate 22. As illustrated in FIG. 2, the second substrate 22 has a size larger than a size of the first substrate 21 positioned above the second substrate 22. All end portions of the second substrate 22 protrude relative to edges of the first substrate 21 in all directions.

As illustrated in FIG. 3, the second substrate 22 has a plurality of, for example, four manifolds 30 that are positioned corresponding to the respective pressure-chamber rows 29 and extend along the conveyance direction. Each of the manifolds 30 partially overlaps a corresponding one of the pressure-chamber rows 29 when viewed in the top-bottom direction, and extend to opposite end portions of the second substrate 22 in the conveyance direction. The opposite end portions of the second substrate 22 protrude relative to the edges of the first substrate 21 and serve as protruding portions 22*a*. The protruding portions 22*a* have a plurality of openings 31 defined therein. More specifically, for example, two openings 31 are provided for each of the manifolds 30 and communicate with respective ends of a corresponding one of the manifolds 30. That is, the rear protruding portion 22*a* has four openings 31 that are in communication with the respective manifolds 30, and the front protruding portion 22*a* has the other four openings 31 that communicate with the respective manifolds 30. The openings 31 of the manifolds 30 are connected to a corresponding one of the ink cartridges 15 via an ink supply member (not illustrated) having an appropriate configuration. That is, in the illustrative embodiment, all of the manifolds 30 are supplied with the same color ink.

As illustrated in FIG. 5, the second substrate 22 has communication holes 32 and 33. The communication holes 32 provide communication between the pressure chambers 28 and the nozzles 36, respectively. The communication holes 33 provide communication between the pressure chambers 28 and a corresponding manifold 30.

With respect to the communication holes 32 correspond to the pressure-chamber rows 29*b* and 29*c*, the communication holes 32 are positioned at respective positions such that the communication holes 32 overlap scanning-direction-outer-end portions of the pressure chambers 28 respectively when viewed in the top-bottom direction. The communication holes 32 communicate with the respective nozzles 36. The communication holes 33 are positioned at respective positions such that the communication holes 33 overlap scanning-direction-inner-end portions of the pressure chambers 28 respectively when viewed in the top-bottom direction. Each communication hole 33 communicate with a corresponding one of the manifolds 30. With respect to the communication holes 32 and 33 corresponds to the pressure-chamber rows 29*a* and 29*d*, the communication holes 32 and 33 are reversed in position relative to the communication holes 32 and 33 for the pressure-chamber rows 29*b* and 29*c*. That is, the communication holes 32 are positioned at respective positions such that the communication holes 32 overlap scanning-direction-inner-end portions of the pressure chambers 28 respectively when viewed in the top-bottom direction. The communication holes 33 are positioned at respective positions such that the communication holes 33 overlap the scanning-direction-outer-end portions of the pressure chambers 28 respectively when viewed in the top-bottom direction.

Flexible damper films 34 are joined to a lower surface of the second substrate 22 so as to cover the manifolds 30. The damper films 34 are configured to reduce pressure fluctuation occurring in the manifolds 30. A protective plate 35 is disposed below each of the damper films 34 via a corresponding metal frame spacer 38. The protective plate 35 protects the corresponding damper film 34 while being spaced from the damper film 24.

The nozzle plates 23*a* and 23*b* are joined to the lower surface of the second substrate 22 while being disposed side by side in the scanning direction. The left nozzle plate 23*a* has nozzles 36 corresponding to the left two pressure-chamber rows 29*a* and 29*b*. The nozzles 36 of the nozzle plate 23*a* constitute a plurality of, for example, two nozzle rows 37*a* and 37*b*. The right nozzle plate 23*b* similarly has nozzles 36 corresponding to the right two pressure-chamber rows 29*c* and 29*d*. The nozzles 36 of the nozzle plate 23*b* constitute a plurality of, for example, two nozzle rows 37*c* and 37*d*. Since the left nozzle plate 23*a* including the left nozzle rows 37*a* and 37*b* and the right nozzle plate 23*b* including the right nozzle rows 37*c* and 37*d* are separate plates, a size of the individual nozzle plates 23 may be reduced considerably as a case where a single nozzle plate includes all the four nozzle rows 37. More specifically, for example, as illustrated in FIG. 5, each of the nozzle plates 23 has a dimension of L1 in the scanning direction. If a relatively-large, single nozzle plate includes all the four nozzle rows 37, the nozzle plate may have a dimension of L2 in the scanning direction. The dimension L1 of each of the nozzle plates 23 is smaller than a half of the dimension L2 of the single channel substrate including all the four nozzle rows 37.

Similar to the pressure-chamber rows 29, the nozzles 36 are aligned along the conveyance direction in each nozzle row 27. Between the nozzle rows 27*a*, 27*b*, 27*c*, and 27*d*, the nozzles 36 are located at the respective different positions along the conveyance direction. More specifically, for example, as illustrated in FIG. 2, the nozzles 36 in each nozzle row 37 are spaced apart from each other with a pitch P (e.g. equal to the pitch P of the pressure chambers 28) in the conveyance direction. Between the four nozzle rows 37, a nozzle 36 in one (e.g., the nozzle row 37*a*) of the nozzle rows 37 is spaced with a pitch P/4 from a pressure chamber in another (e.g., the nozzle row 37*d*) of the nozzle rows 37 in the conveyance direction. With this configuration, for example, in a case where a single nozzle row 37 achieves printing at resolution of 300 dpi, a single head unit 19 including four nozzle rows 37 may print an image at high resolution of 1200 dpi per color.

(Piezoelectric Actuator)

Hereinafter, the piezoelectric actuator 24 will be described. The piezoelectric actuator 24 includes an insulating layer 40 and a plurality of piezoelectric elements 41. The insulating layer 40 is formed on an upper surface of the first substrate 21. The piezoelectric elements 41 are positioned on the insulating layer 40. The piezoelectric actuator 24 is positioned on the first substrate 21 so as to cover the pressure chambers 28.

The insulating layer 40 may be a layer of silicon dioxide formed by, for example, oxidation of a surface of the first substrate 21 made of silicon. The insulating layer 40 has a thickness of, for example, between 1.0 and 1.5 μm. The piezoelectric elements 41 are disposed on an upper surface of the insulating layer 40 so as to overlap the respective pressure chambers 28 when viewed in the top-bottom direction. Similar to the pressure chambers 28, the piezoelectric elements 41 constitute a plurality of, for example, four piezoelectric-element rows 47 that are positioned side by side in the scanning direction. Each of the piezoelectric elements 41 is configured to apply ejection energy for ejecting ink stored in a corresponding pressure chamber 28 from a corresponding nozzle 36.

The piezoelectric elements 41 will be described in detail. As illustrated in FIG. 6, each of the piezoelectric elements 41 includes a lower electrode 42, a piezoelectric layer 43, and an upper electrode 44. The lower electrode 42 is positioned on the insulating layer 40. The piezoelectric layer 43 is positioned on the lower electrode 42. The upper electrode 44 is positioned on the piezoelectric layer 43.

The lower electrode 42 is positioned on an upper surface of the insulating layer 40 so as to overlap the corresponding pressure chamber 28 when viewed in the top-bottom direction. The lower electrode 42 may be an individual electrode to which a drive signal is supplied by a driver IC 60 individually. Similar to the pressure chambers 28, the lower electrodes 42 corresponding to the respective pressure chambers 28 are aligned along the conveyance direction and constitute a plurality of, for example, four electrode rows.

Each of the lower electrodes 42 has an extended portion 45 that extends from a scanning-direction-inner-end portion thereof. The lower electrodes 42 and the extended portions 45 may be made of, for example, platinum (Pt). The lower electrodes 42 and the extended portions 45 each have a thickness of, for example, 0.1 μm.

The piezoelectric layers 43 may be made of, for example, piezoelectric material, e.g., lead zirconate titanate (PZT). Nevertheless, in other embodiments, for example, the piezoelectric layers 43 may be made of lead-free piezoelectric materials. The piezoelectric layers 43 each have a thickness of, for example, between 1.0 and 2.0 μm. As illustrated in FIGS. 3 to 6, in the illustrative embodiment, the piezoelectric layers 43 of the piezoelectric elements 41 corresponding to one or the other of the pressure-chamber rows 29*a* and 29*b* are contiguous to each other. Similar to this, the piezoelectric layers 43 of the piezoelectric elements 41 corresponding to one or the other of the pressure-chamber rows 29*c* and 29*d* are contiguous to each other. That is, two piezoelectric members 46 are disposed on the insulating layer 40. One of the piezoelectric members 46 covers the left two piezoelectric-chamber rows 29*a* and 29*b*. The other of the piezoelectric members 46 covers the right two piezoelectric-chamber rows 29*c* and 29*d*.

As illustrated in FIGS. 3 to 6, each piezoelectric member 46 has slits 48 each extending along the scanning direction. Each slit 48 is positioned between each adjacent two of the pressure chambers 28 with respect to the conveyance direction. The piezoelectric layer 43 has a plurality of separated portions that are separated by the slits 48 at the respective positions between adjacent two of the pressure chambers 28 in the conveyance direction. In other words, a single slit 48 is provided on each side of each pressure chamber 28 in the conveyance direction.

As illustrated in FIGS. 4 and 6, each extended portion 45 connected to a corresponding lower electrode 42 extends inwardly from the lower electrode 42 along the scanning direction. More specifically, for example, the extended portions 45 of the lower electrodes 42 corresponding to one or the other of the pressure-chamber rows 29*b* and 29*c* located on the center side extend inwardly beyond an inner edge of a corresponding piezoelectric member 46, and are uncovered by the piezoelectric member 46. More specifically, for example, the extended portions 45 of the lower electrodes 42 corresponding to one or the other of the pressure-chamber rows 29*a* and 29*d* located on the end sides extend to the respective slits 48 corresponding to the pressure-chamber rows 29*b* and 29*c* located on the center side, and are exposed through the slits 48 (i.e., uncovered by the piezoelectric member 46). Leads 52 are connected to the end portions of the respective extended portions 45 that are uncovered by the corresponding piezoelectric member 46.

The upper electrodes 44 are positioned on the upper surface of the insulating layer 43 so as to overlap the respective pressure chambers 28 when viewed in the top-bottom direction. The upper electrodes 44 may be made of, for example, iridium. The upper electrode 44 has a thickness of, for example, 0.1 μm. In each piezoelectric member 46, the upper electrodes 44 are contiguous to each other at an upper surface of the piezoelectric member 46 and thus constitute a common electrode 49 that covers substantially an entire portion of the upper surface of the piezoelectric member 46. The common electrode 49 consisting of the upper electrodes 44 is applied with ground potential.

As illustrated in FIGS. 3 and 4, each common electrode 49 has a cut 49*a* in each region between each adjacent two of the pressure chambers 28 in the inner side portion in the scanning direction. The cuts 49*a* are cut out from the inner end side. In other words, in each of the pressure-chamber rows 29*b* and 29*d* located on the center side, the common electrode 49 does not lay over the slits 48 each positioned between each adjacent two of the pressure chambers 28 in the conveyance direction.

An auxiliary conductor 50 is disposed on each of the common electrodes 49. The auxiliary conductors 50 are in contact with the respective common electrodes 49. Providing the auxiliary conductor 50 on each of the common electrodes 49 establishes another current-passing route in addition to the route through each of the common electrodes 49, thereby reducing potential difference that may occur in each of the common electrodes 49. The auxiliary conductors 50 may be made of, for example, gold (Au). The auxiliary conductors 50 have a thickness greater than a thickness of the common electrodes 49.

Each of the auxiliary conductors 50 includes a first conductive portion 50*a* and a plurality of, for example, two second conductive portions 50*b*. The second conductive portions 50*b* are electrically continuous to the first conductive portion 50*a*. The first conductive portion 50*a* is disposed at an outer end portion of the piezoelectric member 46 in the scanning direction. The first conductive portion 50*a* extends along the conveyance direction. The second conductive portions 50*b* are disposed at opposite end portions of the piezoelectric member 46 in the conveyance direction. Each of the second conductive portions 50*b* is connected to the first conductive portion 50*a*. The second conduction portions 50*b* extend inwardly from respective ends of the first conductive portion 50*a* toward a central area CA in the scanning direction. The central area CA is located between the left two piezoelectric-element rows 47 and the right two piezoelectric-element rows 47 in the scanning direction.

As described above, the extended portions 45 connected to the respective lower electrodes 42 extend inwardly along the scanning direction from the respective lower electrodes 42, and further extend beyond the piezoelectric member 46. The leads 52 are connected to the exposed end portions of the respective extended portions 45. The leads 52 extend inwardly along the scanning direction from the end portions of the respective extended portions 45 toward the central area CA. Each lead 52 partially lies over a corresponding one of the piezoelectric members 46. The leads 52 extending from the one or the other of the piezoelectric-element rows 47*a* and 47*d*, respectively, positioned on the end sides in the scanning direction, extend through the respective slits 48 corresponding to the one or the other of the pressure-chamber rows 29*a* and 29*d*, respectively, positioned on the center side in the scanning direction. Since the common electrode 49 does not lie over the slits 48, the leads 52 do not contact the common electrode 49. The leads 52 may be made of, for example, gold (Au). The leads 52 are formed by the same layer formation process used for forming the auxiliary conductors 50. The leads 52 have a thickness greater than a thickness of the lower electrodes 42.

In the central area CA defined between the left two piezoelectric-element rows 47 and the right two piezoelectric-element rows 47, a plurality of drive contacts 53 and a plurality of, for example, two ground contacts 54 are positioned. The drive contacts 53 are aligned in a row along the conveyance direction. The ground contacts 54 are positioned upstream and downstream, respectively, of the row of the drive contacts 53 in the conveyance direction. The drive contacts 53 are positioned between the ground contacts 54 in the conveyance direction. The leads 52 are connected to the respective drive contacts 53. The second conductive portions 50*b* of the auxiliary conductor 50 are connected to the respective ground contacts 54.

(Cover Member)

As illustrated in FIGS. 2 and 5, the cover member 25 is disposed on the first substrate 21 so as to cover the piezoelectric elements 41. The cover member 25 has a plurality of, for example, two (e.g., right and left) cover portions 25*a*, and an opening 25*b* defined between the cover portions 25*a* in the scanning direction. The cover portions 25*a* each have a substantially inverted U-shape in cross section. In a state where the cover member 25 is positioned on the first substrate 21, the left cover portion 25*a* covers the left two piezoelectric-element rows 47*a* and 47*b* and the right cover portion 25*a* covers the right two piezoelectric-element rows 47*c* and 47*d*. The opening 25*b* overlaps the central area CA of the first substrate 21 when viewed in the top-bottom direction, and the drive contacts 53 and the ground contacts 54 are exposed through the opening 25*b*. Although material for the cover member 25 is not limited particularly, for example, silicone may be used preferably for the cover member 25.

(COF)

As described above, in the central area CA of the insulating layer 40, the drive contacts 53 and the ground contacts 54 are aligned in a row. One of opposite end portions of a COF 26 (e.g., a wiring member) is joined to the central area CA of the insulating layer 40. Thus, the drive contacts 53 and the ground contacts 54 are electrically connected to the COF 26. In the illustrative embodiment, a single COF 26 is joined to the central area CA. In a case where the drive contacts 53 are aligned with an extremely small pitch, a non-conductive paste ("NCP") or a non-conductive film ("NCF") may be used preferably for joining the COF 26 to the central area CA. The other of the opposite end portions of the COF 26 is connected to the controller 7 (refer to FIG. 1).

The COF 26 includes a driver IC 60 mounted on a portion thereof in the top-bottom direction. The driver IC 60 is electrically connected to the controller 7 via wiring (not illustrated) of the COF 26. The driver IC 60 is also electrically connected to the drive contacts 53 via the wiring of the COF 26. The driver IC 60 is configured to, in response to a control signal transmitted from the controller 7, output a drive signal to appropriate one or more of the lower electrodes 42 connected to the drive contacts 53 to switch the potential of the appropriate one or more of the lower electrodes 42 between a ground potential and a predetermined potential. The ground contacts 54 are electrically connected to a ground wire (not illustrated) of the COF 26, and the upper electrodes 49 constituting the common electrode 49 are kept at the ground potential.

Behavior of each piezoelectric element 41 when a drive signal is supplied to the appropriate one or more of the lower electrodes 42 from the driver IC 60 will be described. Since all of the piezoelectric elements 41 behave in the same manner, an explanation will be made on one of the piezoelectric elements 42. While a drive signal is not supplied to a lower electrode 42, the lower electrode 42 is at the ground potential that is equal to the potential of a corresponding upper electrode 44. In this state, when a drive potential is applied to the lower electrode 42 in response to supply of a drive signal to the lower electrode 42, a potential difference is caused between the lower electrode 42 and the corresponding upper electrode 44 and an electric field that is directed in a direction parallel to a thickness direction of the piezoelectric layer 43 occurs. Due to the occurrence of the electric field, the piezoelectric layer 43 expands in its thickness direction and contracts in its surface-extending direction. Thus, a portion of the insulating layer 40 covering a corresponding pressure chamber 28 deforms so as to protrude toward the pressure chamber 28. Therefore, the volume of the pressure chamber 28 is reduced and a pressure wave occurs in the pressure chamber 28, thereby causing ink ejection from a nozzle 36 communicating with the pressure chamber 28.

Figure 7A:
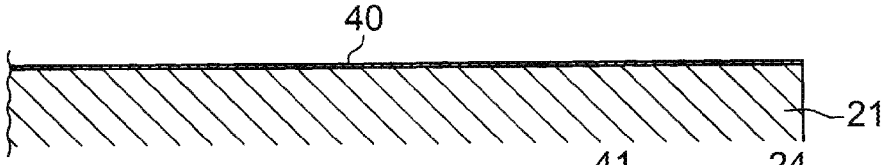
FIGS. 7A to 7G illustrate a process of manufacturing the head unit in the illustrative embodiment according to one or more aspects of the disclosure.
Figure 7B:
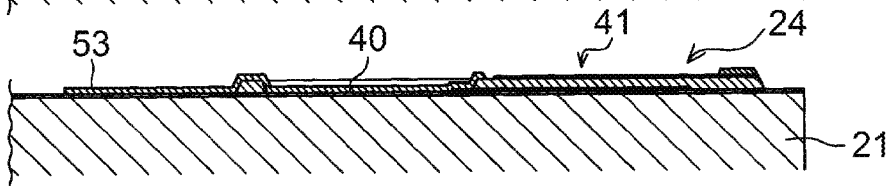
Figure 7C:
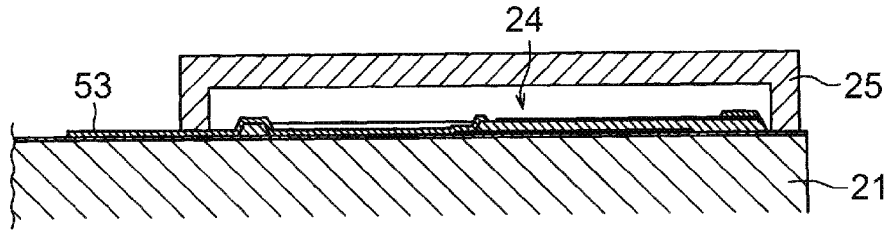

Hereinafter, a process of manufacturing one of the head units 19 will be described in detail. All of the head units 19 are manufactured by the same process. FIGS. 7A to 7G illustrate an example process of manufacturing one of the head units 19. FIGS. 7A to 7C illustrate a portion of a first substrate 21, and FIGS. 7D to 7G illustrates the portion of the first substrate 21 and its corresponding portions only.

More specifically, for example, as illustrated in FIG. 7A, as a first step, a silicon-dioxide insulating layer 40 is formed on one (e.g., an upper surface) of opposite surfaces of a first substrate 21 by heat oxidation. Then, lower electrodes 42, upper electrodes 44, auxiliary conductors 50, leads 52, drive contacts 53, and ground contacts 54 are formed on the insulating layer 40 successively by respective appropriate layer formation methods. Thus, as illustrated in FIG. 7B, a piezoelectric actuator 24 having piezoelectric elements 41 is formed on the insulating layer 40. Subsequent to this, as illustrated in FIG. 7C, a cover member 25 is joined to the first substrate 21 so as to cover appropriate ones of the piezoelectric elements 41, i.e., four rows of piezoelectric elements 41.

Figure 7D:
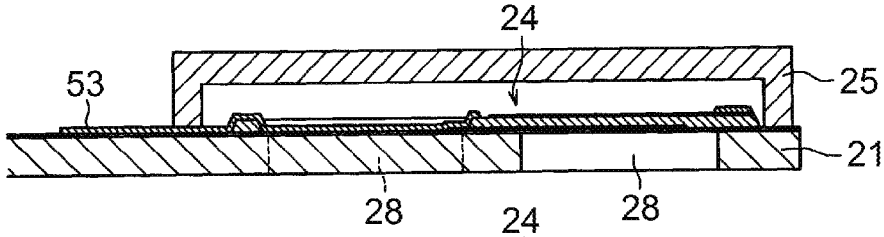
Figure 7E:
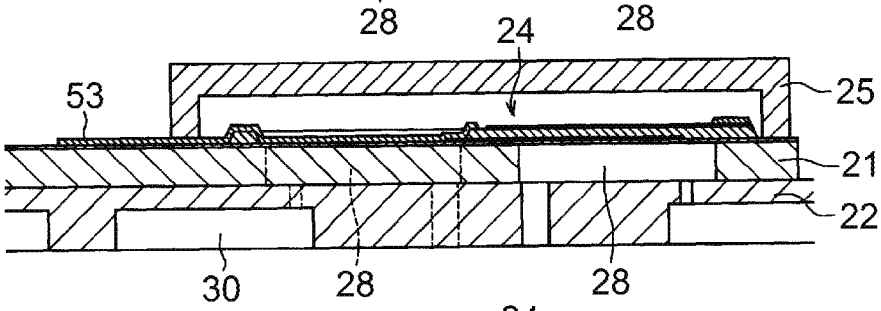
Figure 7F:
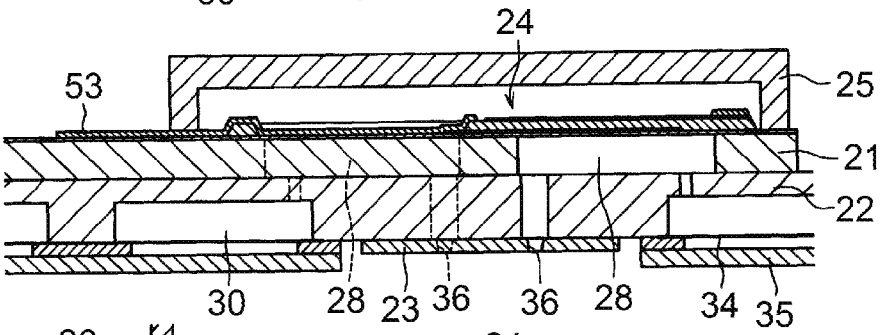

Thereafter, as illustrated in FIG. 7D, the thickness of the first substrate 21 is made to be a predetermined thickness by rubbing of the other surface of the first substrate 21. The other surface is opposite to the one surface on which the piezoelectric elements 41 have been formed. Then, pressure chambers 28 are formed on the first substrate 21 by etching. Then, as illustrated in FIG. 7E, a second substrate 22 is joined to a lower surface of the first substrate 21, and channels including, e.g., manifolds 30, are formed in the second substrate 22 by etching. After that, as illustrated in FIG. 7F, nozzle plates 23, damper films 34, and protective plates 35 are joined to a lower surface of the second substrate 22.

Figure 7G:
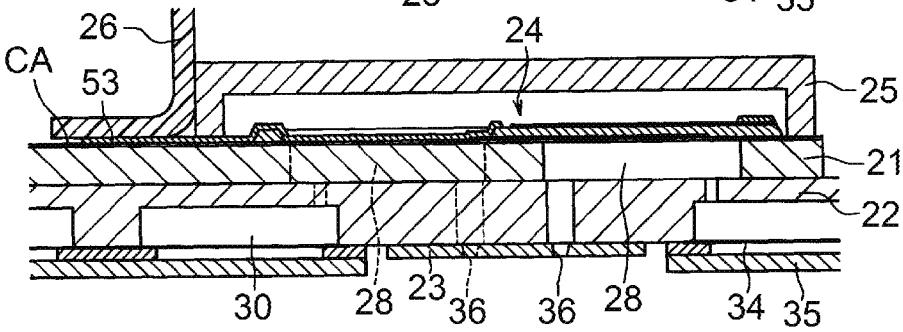

Subsequent to this, as illustrated in FIG. 7G, a COF 26 is joined to a central area CA of the insulating layer 40. More specifically, for example, while a conductive adhesive is applied between the COF 26 and the central area CA of the insulating layer 40, the COF 26 is joined to the first substrate 21 by heat pressing. Thus, the drive contacts 53 and the ground contacts 54 aligned in a row in the central area CA are electrically connected to the COF 26.

According to the illustrative embodiment, in the head unit 19, the pressure chambers 28 are aligned along the conveyance direction and constitute four pressure-chamber rows 29. In accordance with the arrangement pattern of the pressure chambers 28, the piezoelectric elements 41 corresponding to the respective pressure chambers 28 also constitute four piezoelectric-element rows 47. In addition, the drive contacts 53 corresponding to the respective piezoelectric elements 41, and the ground contacts 53 are gathered at the central area CA between the left two piezoelectric-element rows 47*a* and 47*b* and the right two piezoelectric-element rows 47*c* and 47*d* in the scanning direction. As described above, the gathering of the contacts 53 and 54 at the central area CA may enable size reduction of the first substrate 21.

In other embodiments, for example, all the drive contacts 53 corresponding to the respective piezoelectric elements 41 may be gathered at one of the opposite end portions of the first substrate 21 in the scanning direction. This configuration may also enable size reduction of the first substrate 21. Nevertheless, in this case, all the leads 52 may extend in the same direction from the respective piezoelectric elements 41 constituting the four piezoelectric-element rows 52. Thus, in the piezoelectric-element row 47 located closest to the area at which the drive contacts 53 are gathered, three each of the leads 52 may be positioned between each adjacent two of the piezoelectric elements 24 in the conveyance direction. If, however, the pressure chambers 28 are formed with high density for reducing the size of the head unit 19, the piezoelectric elements 41 may need to be arranged with a small pitch in each piezoelectric-element row 47. Therefore, it may be difficult to position three leads 52 between each adjacent two of the piezoelectric elements 41. As opposed to this, in the illustrative embodiment, a single lead 52 is positioned between each adjacent two of the piezoelectric elements 41 in each of the piezoelectric-element rows 47*b* and 47*c* located on the center size. Therefore, the smaller arrangement pitch of the piezoelectric elements 41 might not cause any particular difficulties in routing of the leads 52.

In the illustrative embodiment, the contacts 53 and 54 jointed to the COF 26 are gathered at the central area CA between the left two and right two of the piezoelectric-element rows 47 in the scanning direction. Thus, this configuration may enable size reduction of the area to which the COF 26 is joined, thereby achieving size reduction of the first substrate 21. In addition, the contacts 53 and 54 are aligned in a row and a single COF 26 is joined to the contacts 53 and 54. With this configuration, the size of the area to which the COF 26 is joined may be further reduced, thereby achieving further size reduction of the first substrate 21.

The second substrate 22 joined to the first substrate 21 has the manifolds 30. In other embodiments, for example, the first substrate 21 may have openings for supplying ink to the corresponding manifolds 30. Nevertheless, this configuration may cause increase in size of the first substrate 21 correspondingly. Therefore, in the illustrative embodiment, the end portions of the second substrate 22 in the conveyance direction protrude relative to the edges of the first substrate 21 to provide the protruding portions 22*a*, and the openings 31 for the manifolds 30 are defined in the protruding portions 22*a*. That is, this configuration might not require that the first substrate 21 have the openings 31 for the manifolds 30 therein, thereby enabling restriction of increase in size of the first substrate 21.

If each of the manifolds 30 is supplied with ink from only one of the opposite ends thereof, insufficient distribution of ink may occur in one or more pressure chambers 28 positioned closer to the other end of each of the manifolds 30. Therefore, in the illustrative embodiment, both of the end portions of the second substrate 22 in the conveyance direction protrude relative to the edges of the first substrate 21 to provide the protruding portions 22*a*, and the openings 31 for the manifolds 30 are defined in the protruding portions 22*a*. Consequently, this configuration may achieve ink supply to each of the manifolds 30 from the both ends thereof in the conveyance direction, and may also restrict increase in size of the first substrate 21.

As illustrated in FIG. 5, in the illustrative embodiment, the communication holes 32 that provide communication between the nozzles 36 and the pressure chambers 28, respectively, overlap the outer-end portions of the respective pressure chambers 28 in the pressure-chamber rows 29*b* and 29*c* located on the center side in the scanning direction. As opposed to this, the communication holes 32 overlap the inner-end portions of the respective pressure chambers 28 in the pressure-chamber rows 29*a* and 29*d* located on the end sides in the scanning direction. Such a configuration may reduce a distance between adjacent two nozzle rows 37 corresponding to the pressure-chamber rows 29*a* and 29*b* and a distance between adjacent two nozzle rows 37 corresponding to the pressure-chamber rows 29*c* and 29*d*. Further, the reduction in such distances may further achieve reduction in a distance between nozzle rows 37*a* and 37*d* located on the respective end sides in the scanning direction.

In the illustrative embodiment, the head unit 19 includes the nozzle plate 23*a* having the nozzles 36 corresponding to the left two pressure-chamber rows 29*a* and 29*b*, and the nozzle plate 23*b* having the nozzles 36 corresponding to the right two pressure-chamber rows 29*c* and 29*d*. That is, the nozzle plate 23*a* corresponding to the left pressure-chamber rows 29*a* and 29*b* and the nozzle plate 23*b* corresponding to the right pressure-chamber rows 29*c* and 29*d* are separate plates.

In the illustrative embodiment, a silicon substrate is used as a base material for the nozzle plates 23. The nozzles 36 are formed by etching on the silicon substrate. More specifically, for example, deep silicon etching, such as Bosch process, may be implemented on the silicon substrate to form the nozzles 36 with high aspect ratios. Nevertheless, such etching may increase costs for manufacturing individual silicone nozzle plates 23.

According to the illustrative embodiment, a dimension (e.g., L1 in FIG. 5) of each of the nozzle plates 23 is smaller than a half of a dimension (e.g., L2 in FIG. 5) of a single nozzle plate 23 including all the four nozzle rows 37 in the scanning direction. Therefore, the number of nozzle plates 23 that can be obtained from a single silicon wafer may be increased, thereby reducing the costs for manufacturing individual nozzle plates 23. In addition, the size reduction of individual nozzle plates 23 may increase yields as compared with a case where relatively-large-sized nozzle plates 23 are obtained from a single silicon wafer.

Hereinafter, alternative embodiments in which various changes or modifications are applied to the illustrative embodiment will be described. An explanation will be given mainly for the elements different from the illustrative embodiment, and an explanation will be omitted for the common elements by assigning the same reference numerals thereto.

1] In the illustrative embodiment, with respect to the pressure-chamber rows 29 located on the respective end sides in the scanning direction, the communication holes 32 and 33 are reversed in position relative to the communication holes 32 and 33 for the pressure-chamber rows 29 located on the center side in the scanning direction. Nevertheless, in other embodiments, for example, the communication holes 32 and 33 for the pressure-chamber rows 29 located on the respective end sides in the scanning direction may be positioned on the same respective positions as the communication holes 32 and 33 for the pressure-chamber rows 29 located on the center side in the scanning direction. As illustrated in FIG. 5, in the illustrative embodiment, while the communication holes 32 that provide communication between the nozzles 36 and the pressure chambers 28, respectively, overlap the outer-end portions of the respective pressure chambers 28 in the pressure-chamber rows 29*b* and 29*c* located on the center side in the scanning direction, the communication holes 32 overlap the inner-end portions of the respective pressure chambers 28 in the pressure-chamber rows 29*a* and 29*d* located on the end sides in the scanning direction. In other embodiments, for example, with respect to all of the pressure-chamber rows 29, the communication holes 32 may communicate with the inner-end portions of the respective pressure chambers 28.

2] According to the illustrative embodiment, in each of the head units 19, ink of the same color is supplied to all the four pressure-chamber rows 29 and is ejected from all the four nozzle rows 37. Nevertheless, in other embodiments, for example, in each of the head units 19, all of the nozzle rows 37 might not necessarily eject ink of the same color therefrom. In one example, the left two nozzle rows 37*a* and 37*b* may eject ink of one color and the right two nozzle rows 37*c* and 37*d* may eject ink of another color. In another example, the nozzle rows 37 may eject ink of different colors, respectively.

3] In the illustrative embodiment, the nozzle plates 23 are separate from each other and disposed on the right and left, respectively. Nevertheless, in other embodiments, for example, a relatively large single nozzle plate including all the four nozzle rows 37 may be used.

4] In the illustrative embodiment, the manifolds 30 are provided in a one-to-one correspondence to the pressure-chamber rows 29 so as to overlap the respective pressure-chamber rows 29. Nevertheless, in other embodiments, for example, at least one of the manifolds 30 may be provided in a one-to-two correspondence to the pressure-chamber rows 29 so as to extend between two of the pressure-chamber rows 29.

Figure 8:
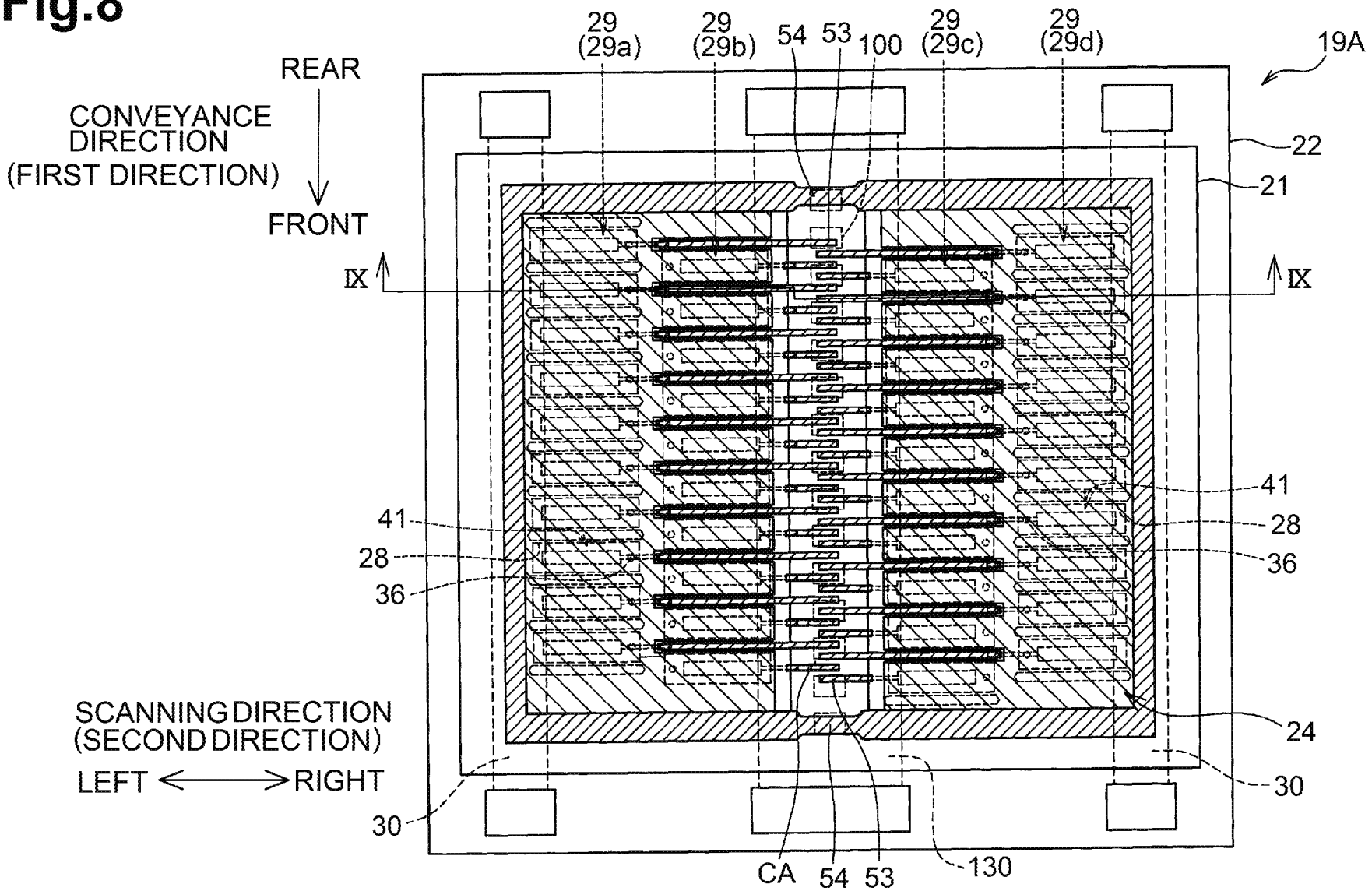
FIG. 8 is a plan view of a head unit in an alternative embodiment according to one or more aspects of the disclosure.
Figure 9:
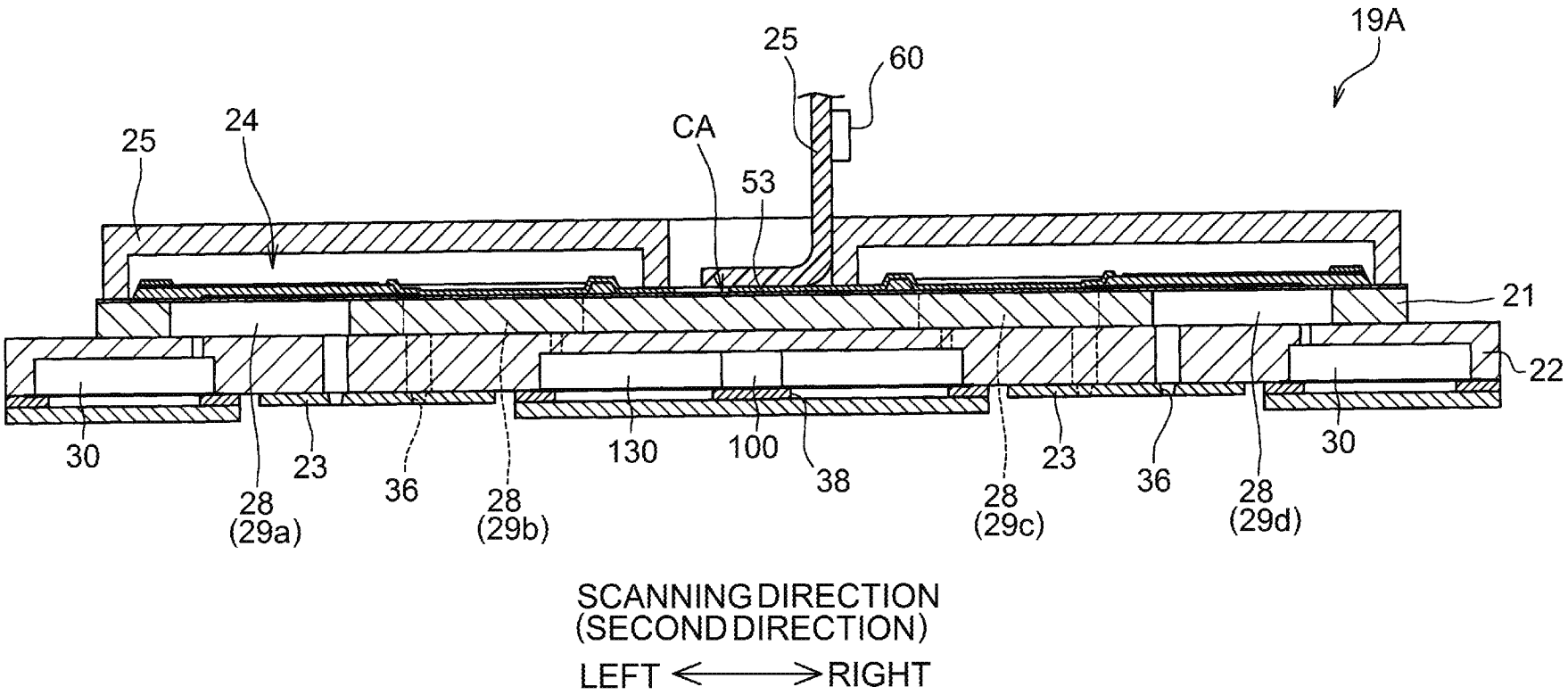
FIG. 9 is a sectional view taken along line IX-IX of FIG. 8 in the alternative embodiment according to one or more aspects of the disclosure.

In one example, as illustrated in FIGS. 8 and 9, in a head unit 19A, the second substrate 22 may have a relatively wide manifold 130 in its central portion in the scanning direction so as to extend between the pressure-chamber rows 29*b* and 29*c*. In each of the pressure-chamber rows 29*b* and 29*c*, the inner-end portions of the pressure chambers 28 may communicate with the manifold 130. That is, the manifold 130 may be configured to supply ink to both of the pressure-chamber rows 29*b* and 29*c* in common. All of the drive contacts 53 and the ground contacts 54 positioned in the central area CA may overlap the manifold 130 when viewed in the top-bottom direction. Nevertheless, in other embodiments, for example, the manifold 130 may overlap at least one or more but not necessarily all of the drive contacts 53 and the ground contacts 54.

In other words, the head unit 19A illustrated in FIGS. 8 and 9 may have three or more manifolds 130 and 30 positioned side by side in the scanning direction. The manifold 130 located on the center side may overlap the drive contacts 53. In this configuration, the manifold 130 may extend across an area where the manifold 130 overlaps the drive contacts 53 and the ground contacts 54 located between the piezoelectric-element rows 29 located on the center side in the scanning direction. With this configuration, the manifold 130 may have a relatively-large volume.

Nevertheless, since, in the second substrate 22, the manifold 130 extending between the pressure-chamber rows 29 located on the center side overlap the drive contacts 53, the second substrate 22 might not have sufficient strength for joining the COF 26 to the drive contacts 53. Therefore, for example, as illustrated in FIGS. 8 and 9, a plurality of supports 100 may be disposed in the manifold 130. The supports 100 may be aligned in a row along the conveyance direction (e.g., a direction orthogonal to the drawing sheet of FIG. 8). Each support 100 may extend from a top surface of the manifold 130 to the metal spacer 38 and contact the spacer 38 via the damper film 34 that may define a lower end of the manifold 130. As illustrated in FIG. 8, the supports 100 may be spaced apart from each other in the conveyance direction. Right and left portions of the manifold 130 relative to the supports 100 communicate with each other via spacings between adjacent supports 100. Each of the supports 100 may overlap a corresponding one of the drive contacts 53 and the ground contacts 54 when viewed in the top-bottom direction. As described above, providing the supports 100 in the manifold 130 may strengthen the portion overlapping the contacts 53 and 54, of the second substrate 22.

Figure 10:
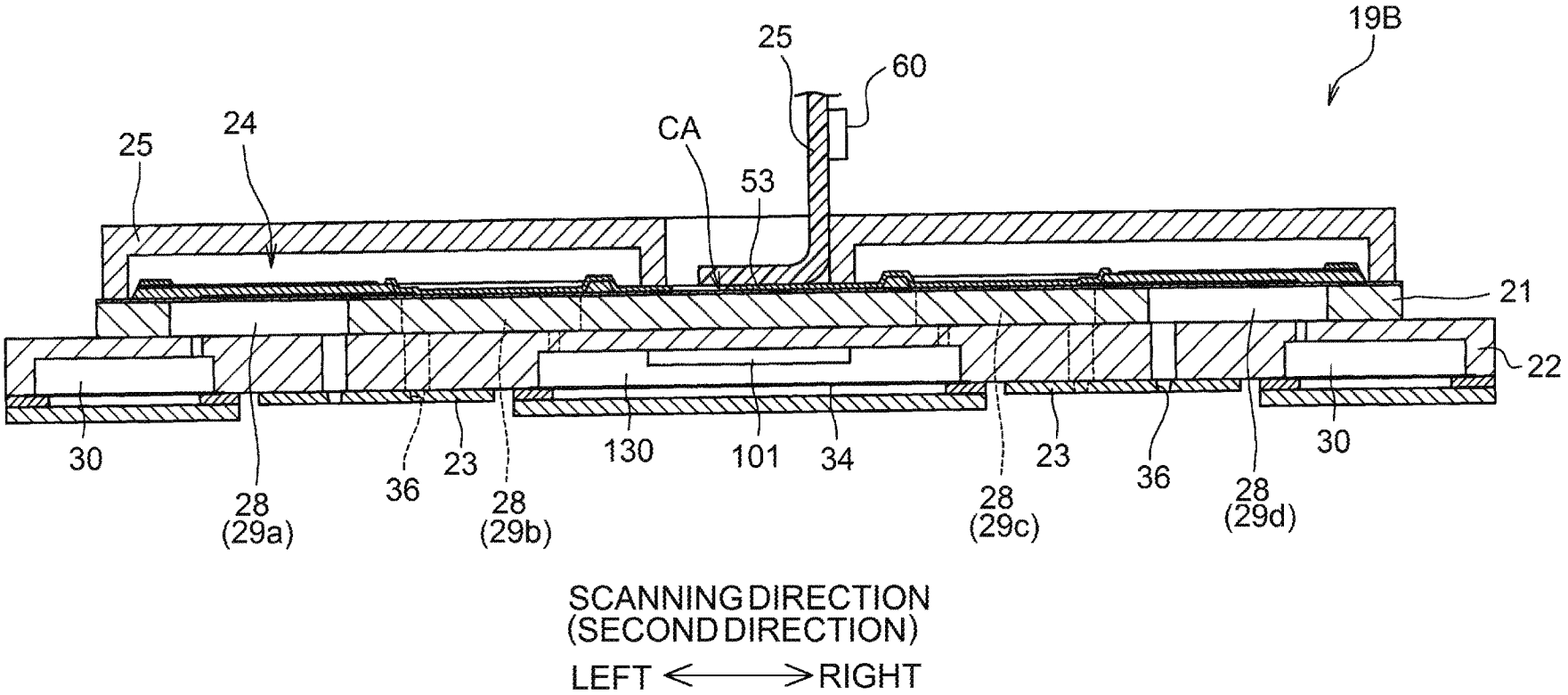
FIG. 10 is a plan view of a head unit in another alternative embodiment according to one or more aspects of the disclosure.

In other embodiments, for example, instead of providing the supports 100 in the manifold 130, as illustrated in FIG. 10, a second substrate 22 of a head unit 19B may include a projecting portion 101 that protrudes downward from an upper surface defining an upper portion of the manifold 130. This configuration may also strengthen the portion overlapping the contacts 53 and 54, of the second substrate 22. The projecting portion 101 may have a width in the scanning direction such that end portions of the projecting portion 101 in the scanning direction overlap inner-side joint portions of the cover member 25, respectively, when viewed in the top-bottom direction. As opposed to the configuration illustrated in FIG. 9, the projecting portion 101 does not contact the spacer 38. Therefore, in this configuration, the spacer 38 might not necessarily be needed below the projecting portion 101 in light of increasing the damper effect. Clearance may be provided between a lower end of the projecting portion 101 and the damper film 34 that may define the bottom of the manifold 130. Therefore, right and left portion of the manifold 130 relative to the projecting portion 101 may communicate with each other via the clearance. In this alternative embodiment, in one example, the second substrate 22 may include a plurality of projecting portions 101 spaced apart from each other in the conveyance direction. In another example, the second substrate 22 may include a single projecting portion 101 extending continuously along the conveyance direction.

5] Various changes may be applied to the positions of the drive contacts 53 in the central area CA or the number of COFs joined to the drive contacts 53 or the positions of the COFs.

Figure 11:
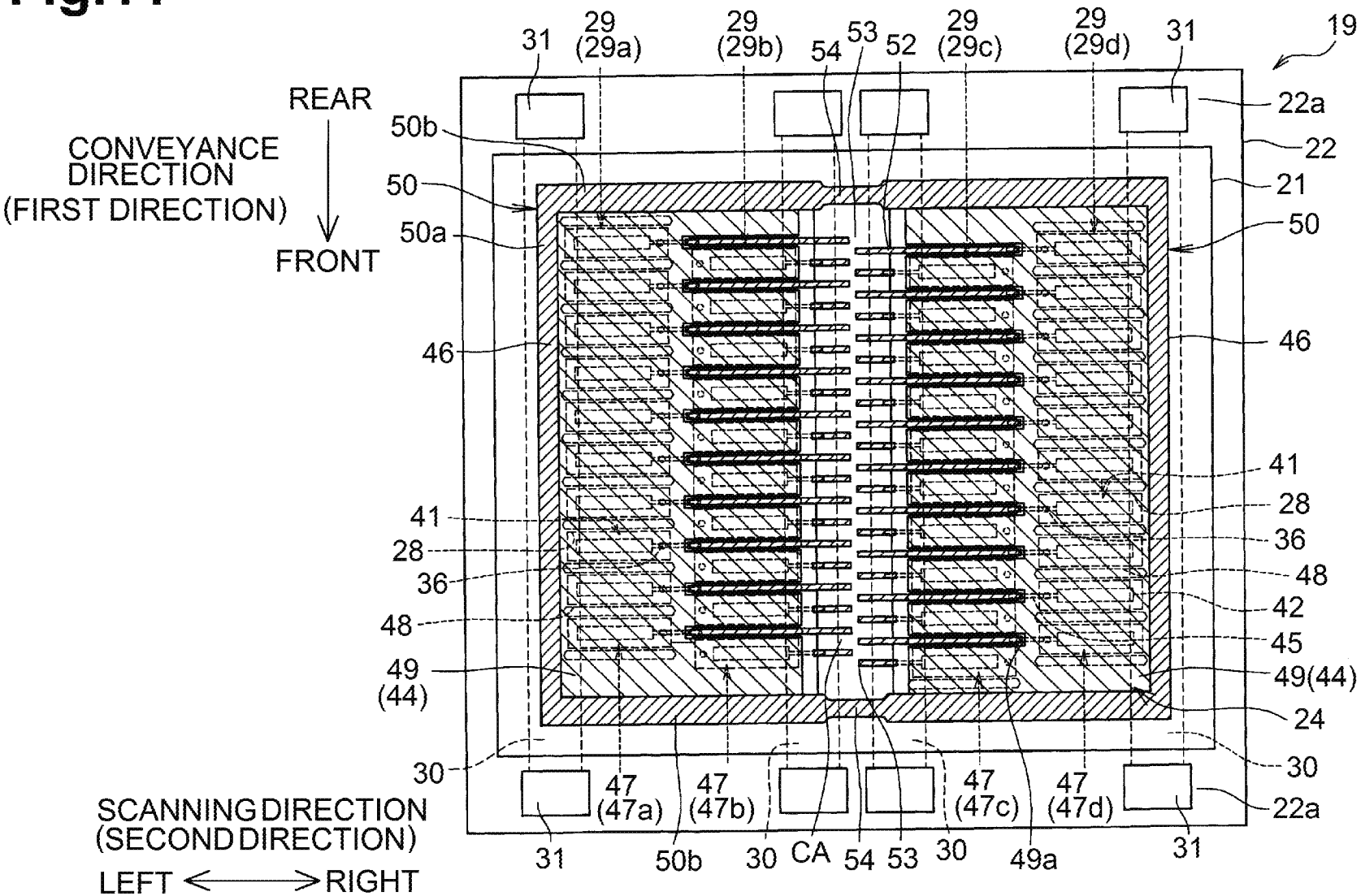
FIG. 11 is a plan view of a head unit in a still another alternative embodiment according to one or more aspects of the disclosure.
Figure 12:
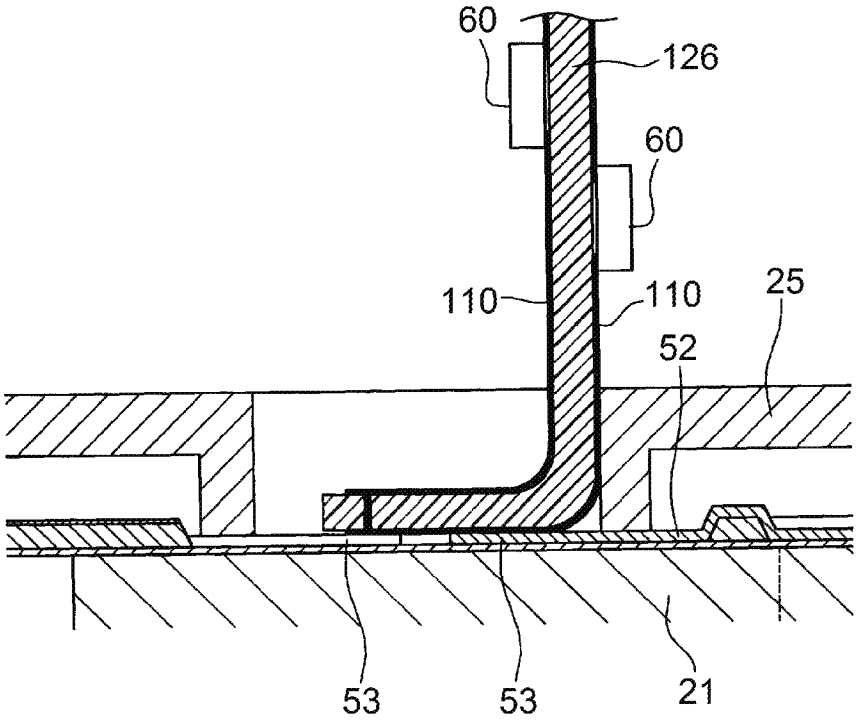
FIG. 12 is an enlarged view of a joint portion between a chip-on-film and a first substrate in the still another alternative embodiment according to one or more aspects of the disclosure.

In the illustrative embodiment, the drive contacts 53 are aligned in a row along the conveyance direction. Nevertheless, in other embodiments, for example, the drive contacts 53 may be aligned in two or more rows along the conveyance direction. In one example, as illustrated in FIG. 11, the drive contacts 53 may be aligned in two rows. More specifically, for example, the drive contacts 53 extending from the left two piezoelectric-element rows 47*a* and 47*b* may be aligned in one row, and the drive contacts 53 extending from the right two piezoelectric-element rows 47*c* and 47*d* may be aligned in another row. If a single wiring member is joined to the drive contacts 53 aligned in two rows, difficulties may occur in providing a wiring pattern on the wiring member. In order to solve such a problem, as illustrated in FIG. 12, a multilayer wiring member 126 having two or more layers of wiring 110 may be used preferably. Further, in the case where the drive contacts 53 are aligned in two rows, the contacts 53 in each row may be arranged with a greater pitch than the pitch of the drive contacts 53 in the illustrative embodiment. In this case, for example, an anisotropic conductive paste ("ACP") or an anisotropic conductive film ("ACF") may be used for joining the wiring member 126 to the drive contacts 53.

In the illustrative embodiment, a single COF 26 is joined to the central area CA. Nevertheless, in other embodiments, for example, two or more COFs 26 may be joined to the central area CA. In one example, in a case where the drive contacts 53 are aligned in two rows and the rows are positioned side by side in the right-left direction, one COF 26 may be joined to one of the rows of the drive contacts 53, and another COF 26 may be joined to the other of the rows of the drive contacts 53. In another example, two or more COFs 26 may be joined to the drive contacts 53 while being aligned in the conveyance direction. More specifically, for example, in a case where the drive contacts 53 are aligned in a row. One COF 26 may be joined to a front half of the row of the drive contacts 53, and another COF 26 may be joined to a rear half of the row of the drive contacts 53.

However, if the drive contacts 53 are aligned in two or more rows or if two or more COFs 26 are jointed to the drive contacts 53, a larger area to which COFs 26 are joined may be required as compared with the area of the illustrative embodiment. Nevertheless, gathering the drive contacts 53 on a single location may achieve the size reduction of the first substrate 21 as compared with a known configuration in which the drive contacts are located at two or more locations.

6] In the illustrative embodiment, the pressure chambers 28 of the first substrate 21 constitute four pressure-chamber rows 29. Nevertheless, in other embodiments, for example, the pressure chambers 28 of first substrate 21 may constitute five or more pressure-chamber rows 29.

The description has been made on the example in which the disclosure is applied to the inkjet head for printing an image on a recording sheet by ejecting ink therefrom. Nevertheless, in other variations or embodiments, for example, the disclosure may be applied to other liquid ejection devices used for various purposes. For example, the disclosure may be applied to a liquid ejection device configured to form conductive patterns on a surface of a substrate by ejecting conductive liquid onto the substrate.

What is claimed is:

1. A liquid ejection device comprising:

a first substrate having two pressure-chamber rows, wherein each of the two pressure-chamber rows has a plurality of pressure chambers, each of the two pressure-chamber rows extends along a first direction and each of the two pressure-chamber rows is offset from one another in a second direction orthogonal to the first direction;

two piezoelectric-element rows positioned corresponding to the two pressure-chamber rows, respectively, wherein each of the two piezoelectric-element rows has a plurality of piezoelectric elements, each of the two piezoelectric-element rows extends along the first direction and each of the two piezoelectric-element rows is offset from one another in the second direction;

a plurality of contacts aligned along the first direction between the two piezoelectric-element rows in the second direction, and a second substrate located opposite to the piezoelectric elements relative to the first substrate, wherein the second substrate has a common liquid chamber communicating with at least one of the two pressure-chamber rows, wherein the plurality of contacts overlap the common liquid chamber when viewed in a third direction in which the first substrate and the second substrate are laminated on one another, and wherein a support is disposed in the common liquid chamber of the second substrate.

2. The liquid ejection device according to claim 1, wherein the support overlap at least one of the plurality of contact when viewed in the third direction.

3. The liquid ejection device according to claim 1, wherein the common liquid chamber communicating with the two pressure-chamber rows.

4. The liquid ejection device according to claim 1, wherein the second substrate has two end portions in the first direction, wherein the one of the two end portions of the second substrate in the first direction includes a first protruding portion, wherein the first protruding portion protrudes outwardly in the first direction relative to an edge of the first substrate, and wherein the first protruding portion of the second substrate has an opening communicating with the common liquid chamber.

5. The liquid ejection device according to claim 4, wherein the other of the two end portions of the second substrate in the first direction includes a second protruding portion, wherein the second protruding portion protrudes outwardly in the first direction relative to another edge of the first substrate, and wherein the second protruding portion of the second substrate has another opening communicating with the common liquid chamber.

6. A liquid ejection device comprising:

a first substrate having two pressure-chamber rows, wherein each of the two pressure-chamber rows has a plurality of pressure chambers, each of the two pressure-chamber rows extends along a first direction and each of the two pressure-chamber rows is offset from one another in a second direction orthogonal to the first direction;

two piezoelectric-element rows positioned corresponding to the two pressure-chamber rows, respectively, wherein each of the two piezoelectric-element rows has a plurality of piezoelectric elements, each of the two piezoelectric-element rows extends along the first direction and each of the two piezoelectric-element rows is offset from one another in the second direction;

a plurality of contacts aligned along the first direction between the two piezoelectric-element rows in the second direction, and a second substrate located opposite to the piezoelectric elements relative to the first substrate, wherein the second substrate has a common liquid chamber communicating with at least one of the two pressure-chamber rows, wherein the plurality of contacts overlap the common liquid chamber when viewed in a third direction in which the first substrate and the second substrate are laminated on one another, wherein the second substrate includes a projecting portion at a wall thereof, wherein the wall defines a portion of the common liquid chamber.

7. The liquid ejection device according to claim 6, wherein the projecting portion overlap at least one of the plurality of contact when viewed in the third direction.

8. The liquid ejection device according to claim 6, wherein the common liquid chamber communicating with the two pressure-chamber rows.

9. The liquid ejection device according to claim 6, wherein the second substrate has two end portions in the first direction, wherein the one of the two end portions of the second substrate in the first direction includes a first protruding portion, wherein the first protruding portion protrudes outwardly in the first direction relative to an edge of the first substrate, and wherein the first protruding portion of the second substrate has an opening communicating with the common liquid chamber.

10. The liquid ejection device according to claim 9, wherein the other of the two end portions of the second substrate in the first direction includes a second protruding portion, wherein the second protruding portion protrudes outwardly in the first direction relative to another edge of the first substrate, and wherein the second protruding portion of the second substrate has another opening communicating with the common liquid chamber.

* * * * *